US005307661A

United States Patent [19]

Fink et al.

[11] Patent Number: 5,307,661

[45] Date of Patent: May 3, 1994

[54] SYSTEM AND METHOD FOR SHOT PEENING REACTOR VESSEL PENETRATIONS

[75] Inventors: David J. Fink, Greentree; Bruce W. Bevilacqua, Export, both of Pa.

[73] Assignee: Westinghouse Electric Corp., Pittsburgh, Pa.

[21] Appl. No.: 54,492

[22] Filed: Apr. 27, 1993

[51] Int. Cl.[5] ..... B24C 3/16

[52] U.S. Cl. ..... 72/53; 51/411; 51/320

[58] Field of Search ..... 72/53; 29/90.7; 51/319, 51/320, 411, 417, 419

[56] References Cited

U.S. PATENT DOCUMENTS

| | | | |
|---|---|---|---|
| 4,219,976 | 9/1980 | Burack et al. | 51/411 |
| 4,432,220 | 2/1984 | Loersch et al. | 72/53 |
| 4,616,497 | 10/1986 | Harman et al. | 72/53 |
| 4,616,498 | 10/1986 | Bevilacqua et al. | 72/53 |
| 4,619,128 | 10/1986 | Harman et al. | 72/53 |
| 4,713,952 | 12/1987 | Senger et al. | 72/53 |
| 4,821,545 | 4/1989 | Druelle et al. | 72/53 |
| 4,893,490 | 1/1990 | Isnardon et al. | 72/53 |
| 4,974,434 | 12/1990 | Reccius et al. | 72/53 |
| 5,107,631 | 4/1992 | Wern | 72/53 |

*Primary Examiner*—David Jones

*Attorney, Agent, or Firm*—Payton C. Watkins

[57] ABSTRACT

A method for shot peening a first tube external to and concentric with a second tube comprising the steps of forming a slot through the second tube; positioning a shot peening device adjacent the notch in the second tube for propelling shot peening balls; propelling the shot peening balls through the slot in the second tube for shot peening the second tube; and rotating the second tube in increments for shot peening an entire circumferential portion of the first tube positioned outwardly and radially from the slot.

12 Claims, 4 Drawing Sheets

SYSTEM AND METHOD FOR SHOT PEENING REACTOR VESSEL PENETRATIONS

BACKGROUND OF THE INVENTION

1. Field of the Invention

The present invention relates generally to shot peening and, more particularly, is concerned with a system and method for shot peening reactor vessel penetrations.

2. Background of the Invention

In nuclear power generation, a reactor vessel is the primary vessel wherein heat is created for producing steam. Uranium pellets positioned within the reactor vessel produce a controlled nuclear fission for generating this heat. The cylindrical reactor vessel includes a hemispherical bottom and a flanged, removable upper head. To control the nuclear fission process, a plurality of control rods are selectively inserted into or withdrawn in predetermined fashion from the reactor vessel. Control rods are typically stainless steel tubes encapsulating an absorber material, and extend into the reactor vessel when fully inserted. To accomplish this control rod insertion, a plurality of penetrations (stainless steel tubes) pass through the reactor head and into the interior of the reactor vessel. A tubular shaped thermal sleeve is disposed concentrically inside each penetration and external to the control rods (i.e., between the penetration and the control rod). The thermal sleeve includes a flange at each end. One flange rests on a chamfered end of the penetration tube for support, and the other flange extends beyond the corresponding opposite end of the penetration. This arrangement, in effect, prevents the thermal sleeve from being removed. The thermal sleeve protectively covers the control rods and functions to protect the control rods from acute temperature changes.

The penetrations are welded by conventional methods to the reactor vessel head for structural support. However, this welding, although structurally sound, causes stress on the penetrations adjacent the weldments. It becomes, therefore, desirable to relieve this stress on the penetrations. It is well known in the art that shot peening relieves this type of stress on such tubes.

Although shot peening is efficient, it is not without drawbacks in certain situations. Conventional shot peening methods have drawbacks where a liner (such as the thermal sleeve) surrounds the tube to be shot peened. This is because, typically, there is only an eighth of an inch between the sleeve and the penetration. It is, therefore, difficult to effectively shot peen behind this liner without removing the thermal sleeve and, consequently, causing damage to the thermal sleeve during such removal. Replacing a damaged penetration is costly and time consuming.

Therefore, a need exists for improvements in the construction and mode of operating the shot peening mechanism where a liner covers and conceals the surface to be shot peened.

SUMMARY OF THE INVENTION

The present invention provides an improvement designed to satisfy the aforementioned needs. Particularly, the present invention is directed to a method for shot peening a first tube external to and concentric with a second tube, comprising the steps of: a) forming a slot through the second tube; b) positioning a shot peening device adjacent the slot in the second tube for propelling shot peening balls ; c) propelling the shot peening balls through the slot in the second tube for shot peening the first tube; and d) rotating the second tube in increments for shot peening an entire circumferential portion of the first tube positioned outwardly and radially from the notch.

Further, in accordance with the present invention, there is provided a system for shot peening a first tube external to and concentric with a second tube, the system comprising: a) cutting means for cutting a slot through the second tube; b) a shot peening device cooperating with said cutting means for shot peening the first tube; c) positioning means attached to said shot peening device for positioning said shot peening device inside the second tube adjacent the slot in the second tube; and d) propelling means attached to and cooperating with said shot peening device for propelling shot peening balls through the slot in the second tube for shot peening the first tube.

BRIEF DESCRIPTION OF THE DRAWINGS

In the course of the following description reference will be made to the attached drawings in which.

DESCRIPTION OF THE PREFERRED EMBODIMENT

Figure 1:
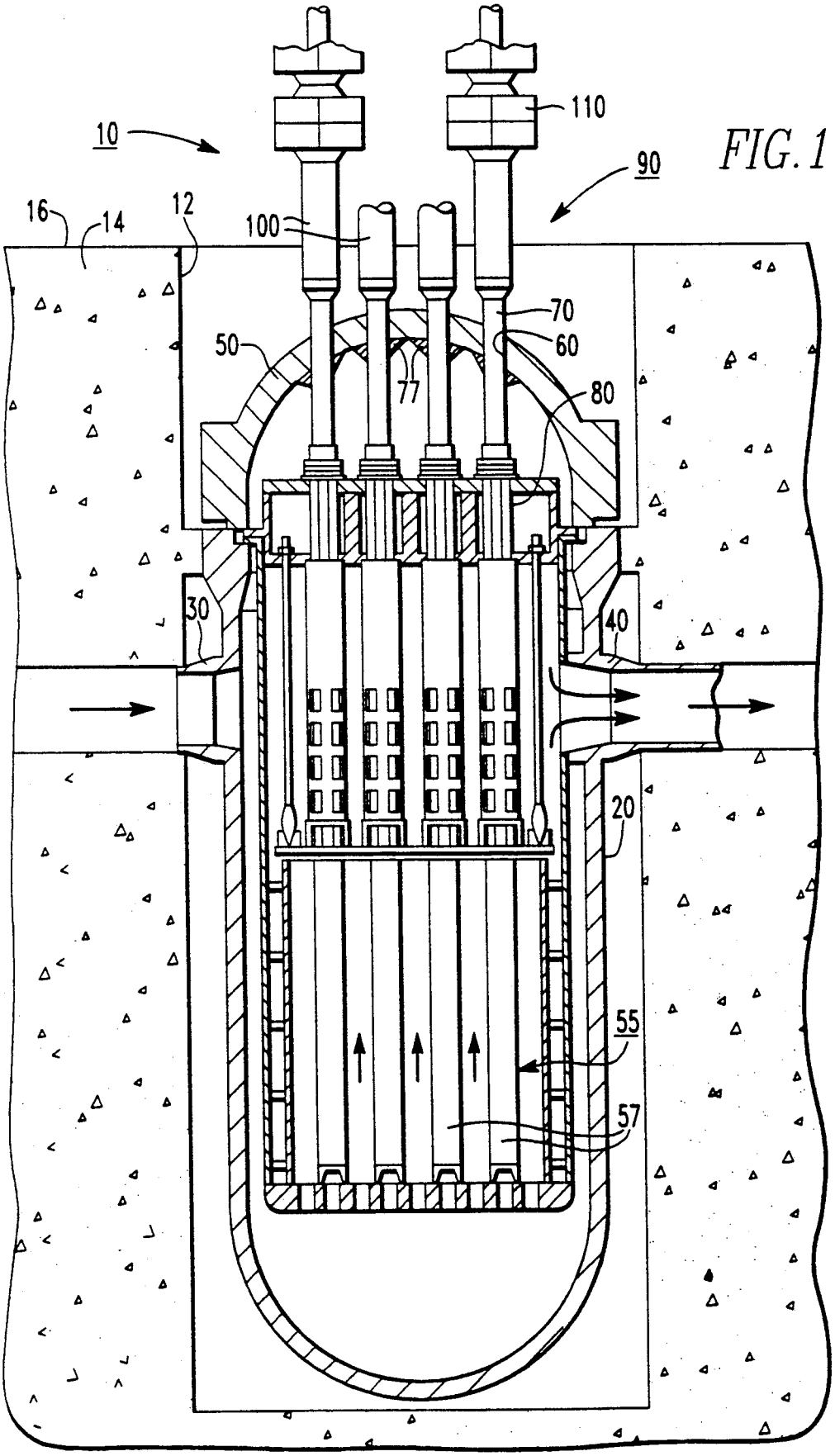
FIG. 1 illustrates in partial, vertical section a typical nuclear power reactor pressure vessel with parts removed for clarity.

In the following description, like reference characters designate like or corresponding parts throughout the several views of the drawings. Also, in the following description, it is to be understood that such terms as "forward", "left", "right", "upwardly", "downwardly", and the like are words of convenience and are not to be construed as limiting terms.

Referring to FIG. 1, there is shown a typical nuclear power reactor, generally referred to as 10, for producing heat by a controlled fission of a fissionable material (not shown). The reactor 10 is disposed in a reactor cavity 12 defined by a containment structure 14 having a top surface 16 thereon. The reactor 10 includes a cylindrical bottom 20 open at its top end and having a plurality of inlet nozzles 30 and outlet nozzles 40 attached to the upper portion thereof (only one of each nozzle is shown). A flanged, hemispherical reactor vessel closure head 50, which may be carbon steel, is mounted atop the bottom 20 and is sealingly attached to the open top end of the bottom 20 so that the closure head 50 sealingly caps the bottom 20. Capping the bottom 20 in this manner allows for suitable pressurization of the coolant (not shown) circulating through the bottom 20 as the reactor 10 operates. The coolant may be borated demineralized water maintained at a relatively high pressure of approximately 2500 psia and a temperature of approximately 650 degrees Fahrenheit.

A reactor core 55 is disposed in the interior of the reactor 10. The reactor core 55 comprises a plurality of nuclear fuel assemblies 57 containing the fissionable material. A plurality of closure head openings 60 are formed through the top of closure head 50 for respectively receiving a plurality of generally tubular control rod drive mechanism (CRDM) penetration tubes 70. Each penetration tube 70 is affixed to the closure head 50 by weldments 77. Each CRDM penetration tube 70 houses a control rod drive shaft (not shown) extending therethrough; the drive shaft engaging at least one movable control rod cluster (not shown) comprising an absorber for controlling the fission process in the reactor core 55.

A CRDM 90 is connected to the penetration tube 70 for axially moving a drive rod 80 and thus the control rod cluster connected thereto. The CRDM comprises a generally tubular pressure housing 100, which may be "TYPE 304" stainless steel. An electromagnetic coil stack assembly 110 is attached to the pressure housing 100 for electromagnetically axially moving the drive rod 80 as the coil stack assembly 110 is electrically energized.

As the reactor 10 operates, the coolant enters the bottom 20 and circulates therethrough generally in the direction of the arrows. As the coolant circulates through the bottom 20, it also circulates over the fuel assemblies 57 for assisting in the fission process and for removing the heat produced by fission of the fissionable material contained in the fuel assemblies 57. The coil stack assemblies 110 axially move the control rod clusters in and out of fuel assemblies 57 to suitably control the fission process therein. The heat generated by the fuel assemblies 57 is ultimately transferred to a turbine-generator set for producing electricity in a manner well known in the art.

Figure 2:
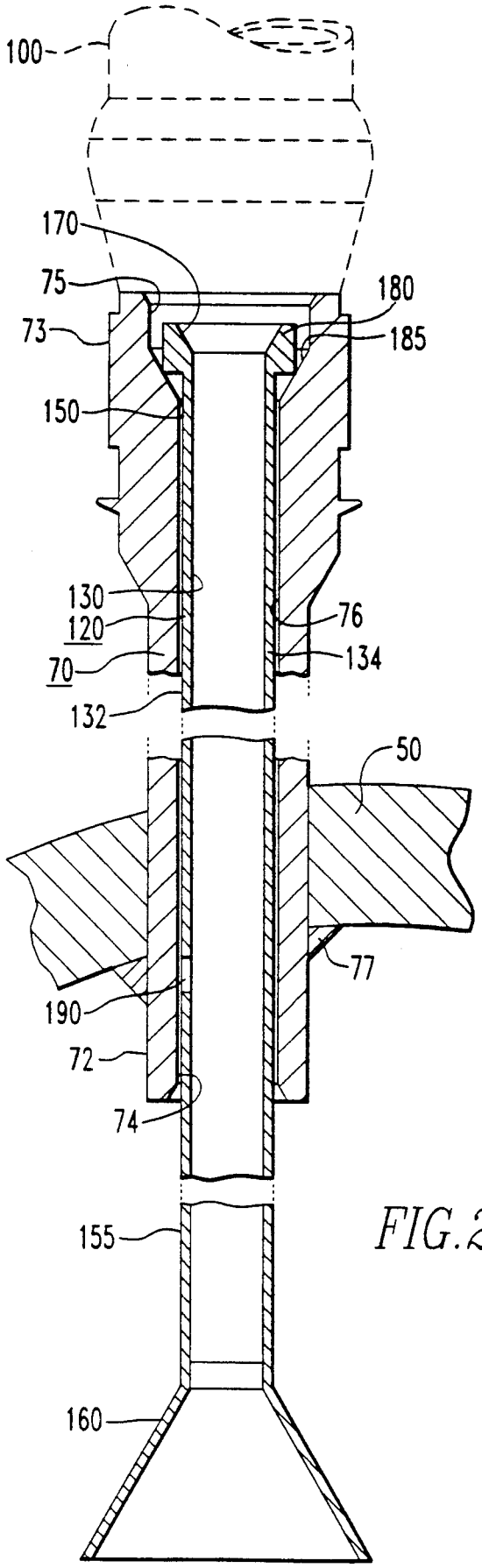
FIG. 2 illustrates in vertical section a penetration tube with a thermal sleeve, containing a longitudinal slot of the present invention, disposed concentrically inside the penetration tube.

Referring to FIG. 2, the penetration tube 70 includes a bottom end 72 and a top end 73 respectively defining an open first mouth 74 and an open second mouth 75. An inner surface 76 of the penetration tube 70 surrounds a generally tubular thermal sleeve 120 concentrically mounted in the tube 70. The sleeve 120 has an inside surface 130 and an outside surface 132 defining a wall thickness 134 therebetween. The sleeve 120 also has a top end portion 150 and a bottom end portion 155 respectively defining an open first mouth 160 and an open second mouth 170. The top end portion 150 of the sleeve 120 has an annular flange 180 surrounding the open second mouth 170 for mounting the sleeve 120 on a chamfered edge 185 of the tube 70. The flange 180 is mounted on the edge 185 so that the sleeve 120 is freely suspended from the edge 185 of the inner surface 76 of the tube 70. It will be appreciated from the description hereinabove that the flange 180 is not affixed to the edge 185; rather, flange 180 merely rests on edge 185 and is, therefore, circularly slidable on the edge 185.

Figure 3:
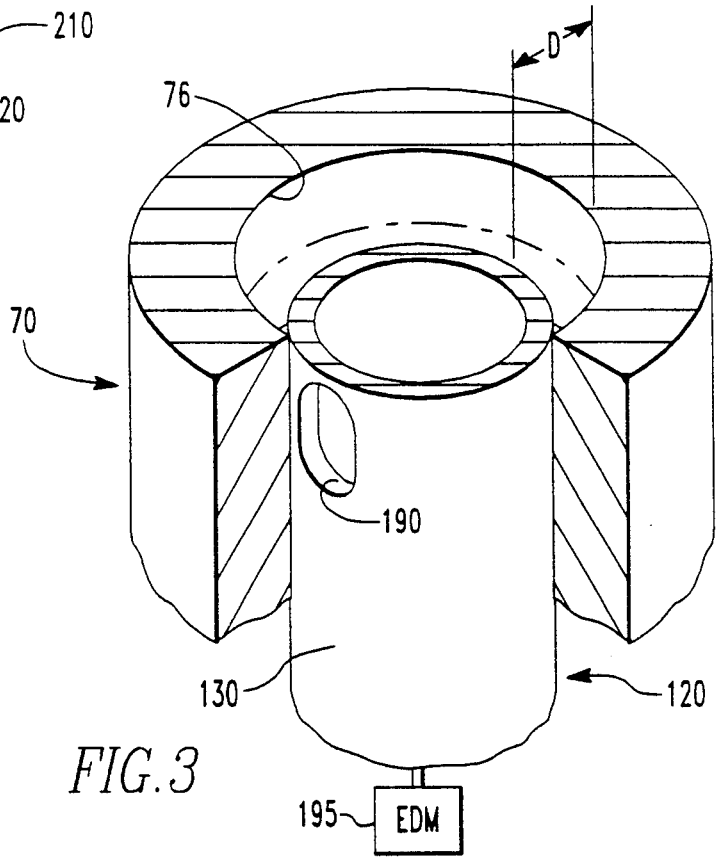
FIG. 3 illustrates in detail the slot in the thermal sleeve.

Referring to FIGS. 2 and 3, the distance D between the outer surface 130 of the thermal sleeve 120 and the inner surface 76 of the penetration 70 is typically an eighth of an inch. Therefore, access to the inner surface 76 of the penetration tube 70 is limited, if accessible at all, to perform shot peening, because the thermal sleeve 120 may not be removed (due to the flanges 160 and 170 of the thermal sleeve 120, see FIG. 2) without significantly damaging it. To overcome this inaccessibility, a longitudinal slot 190 (22 mm wide and 270 mm long) is cut through the thermal sleeve 120. This cutting may be performed by a variety of methods, such as by electro discharge machining (EDM) 195 as is well known in the art.

A shot peening device may then be inserted into the thermal sleeve 120 by a means such as is disclosed in U.S. patent application Ser. No. 07/850,543 filed Mar. 13, 1992 which is assigned to the assignee of the present invention. The disclosure of this application is hereby incorporated by reference. This application discloses a shot peening nozzle which is extended into a tube and retracted out of the tube by an integral drive unit on an end effector. The drive unit includes a pair of horizontally spaced drive wheels between which a hose passes. A third drive wheel clamps the hose against an idler wheel which drives an encoder. A motor rotates the drive wheels to feed the hose and, therefore, the nozzle into the tube. The shot peening balls are then propelled up through the nozzle by a propelling means for shot peening a desired surface. The balls are then recovered and arranged to be recycled through the shot peening device.

Figure 4A:
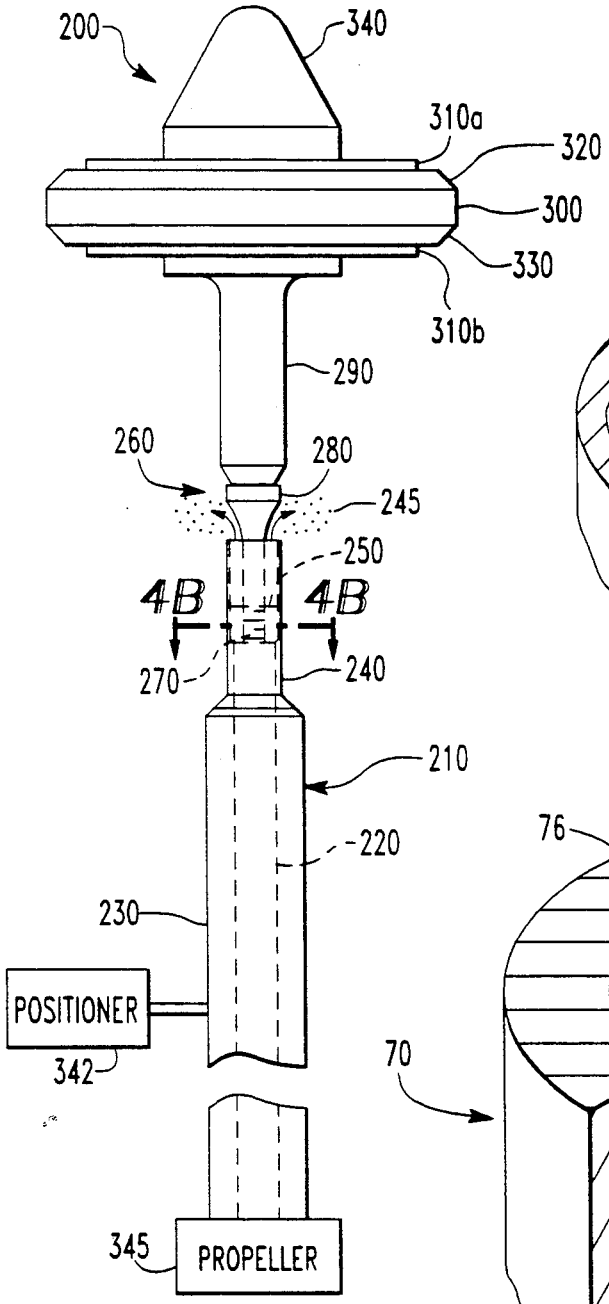
FIG. 4A illustrates a panoramic nozzle in side elevation of the present invention for shot peening the penetration tube.
Figure 4B:
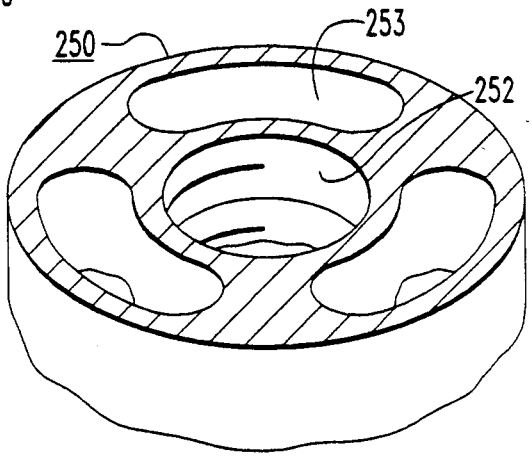
FIG. 4B illustrates a perspective view taken along line 4B—4B of FIG. 4A.

Referring to FIG. 4A, a panoramic shot peening nozzle 200 is shown. The nozzle 200 includes a probe assembly 210 for protectively covering a hose 220 therein. The probe assembly 210 includes a lower portion 230 which tapers and connects to an upper portion 240. The hose 220 for passing shot peening balls 245 therethrough is attached to a circular, perforated plate 250. In this regard, and referring to FIG. 4B, the plate 250 includes a threaded center portion 252 for receiving a deflector 260 (see FIG. 4A) A plurality of circumferentially spaced apart arcuate notches 253 are formed through the plate 250. The arcuate notches 253 function to allow the shot peening balls 245 to pass upwardly therethrough. Referring back to FIG. 4A, the plate 250 is welded to the probe assembly 210 for support.

The deflector 260 is matingly threaded into the threaded center portion 252 of the plate 250 and includes a threaded, tapered lower portion 270 which is received in the threaded center portion 252 (see FIG. 4B) and an enlarged upper portion 280 for deflecting the shot peening balls 245. The shot peening balls 245 pass out of the gate 250 and deflect off the deflector 260 causing the shot peening balls 245 to be dispersed radially as illustrated by the arrows. A generally conical shaped spacer 290 is attached atop the deflector 260, and a brush 300, which fits snugly into the thermal sleeve 120 (see FIG. 3), is attached atop the spacer 290. The brush 300, when inserted into the thermal sleeve 120, prevents the shot peening balls 245 from passing upwardly past the brush 300. Two washers **310*a* and 310*b* are respectively positioned adjacent a top portion 320 and a bottom portion 330 of the brush 300 for supporting the brush 300. A tapered nose 340 is positioned atop the washer 310*a* for guiding the nozzle 200 into the thermal sleeve 120. A positioner 342 and a propeller 345, both described in the previously mentioned U.S. patent application 07/850,543 filed Mar. 13, 1992, are attached to the probe assembly 210. The positioner 342 functions to insert and withdraw the nozzle 200 from the thermal sleeve 120, and the propeller 345 functions to propel the shot peening balls 245 through the hose 220 and out of the nozzle 200**.

When operational, and referring to FIGS. 3 and 4A, the nozzle 200 is inserted into the thermal sleeve 120 so that the brush 300 is positioned above the longitudinal slot 190. The shot peening balls 245 deflect off the deflector 260 causing a portion of the balls 245 to pass through the slot 190. The balls 245, which pass though the slot 190, shot peen the inner surface 76 of the penetration 70. All of the balls 245, whether passing through the slot 190 or not passing through the slot 190, then fall downwardly and are recycled for further shot peening through a process described in the previously mentioned U.S. patent application 07/850,543 filed Mar. 13, 1992.

Figure 5:
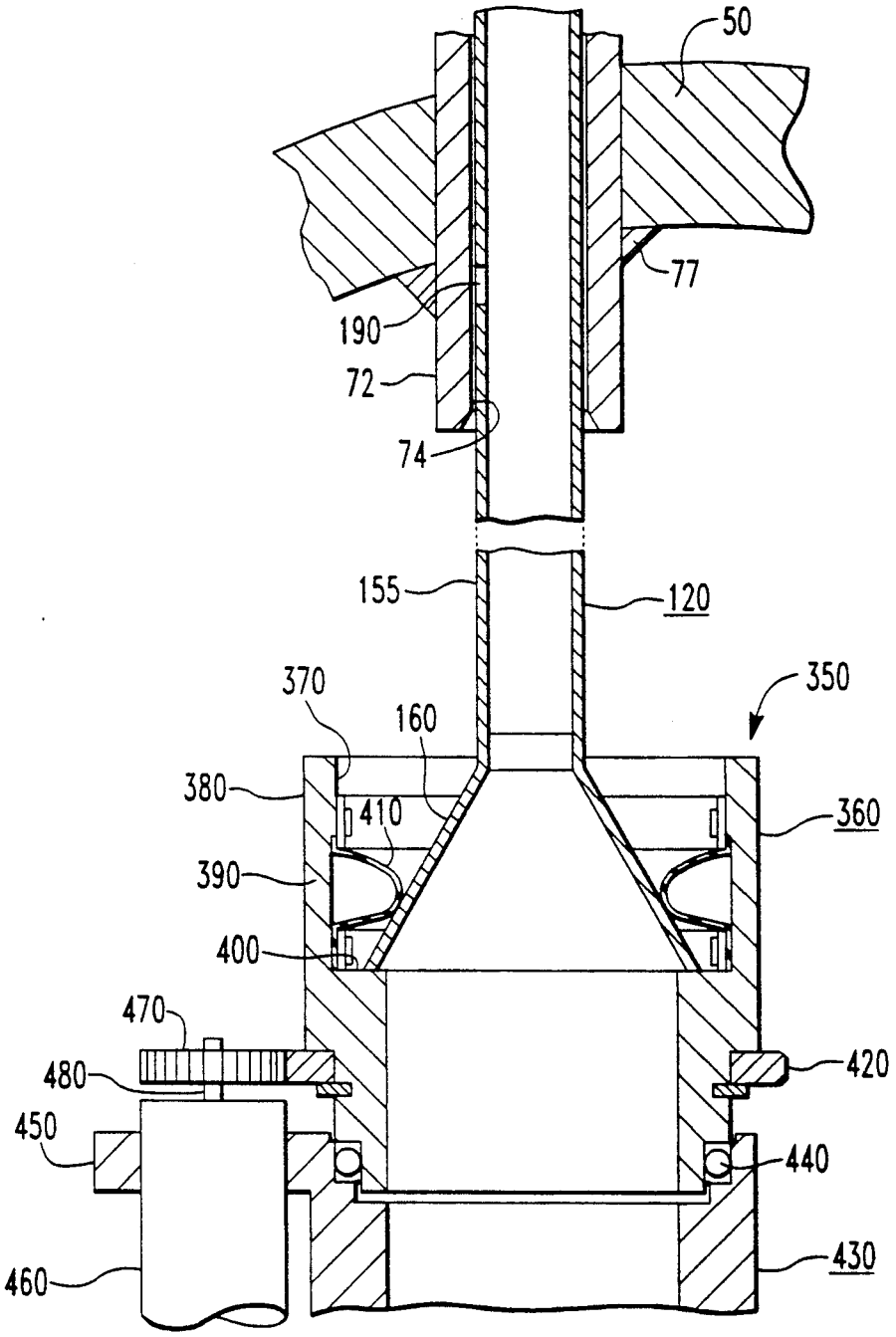
FIG. 5 illustrates a rotational device of the present invention in side elevation for rotating the thermal sleeve.

After shot peening the portion of the penetration 70 disposed outwardly from the slot 190, the thermal sleeve 120 is rotated in increments so that the entire circumferential portion of the thermal sleeve 120 adjacent the weldment 77 is shot peened. Referring to FIG. 5, a device 350 for rotating the thermal sleeve 120 is shown. The device 350 includes a circular, rotatable chamber 360 which surrounds and encloses the first open mouth 160 of the thermal sleeve 120. The chamber 360 includes an inner surface 370 and an outer surface 380 defining a wall thickness 390 therebetween. The inner surface 370 defines a lip portion 400 for supporting the sleeve 120. The lip portion 400 is suspended at a height so that the flange 180 (see FIG. 2) is positioned up and away from the chamfered edge 185, allowing the sleeve to be rotated without resistance from the chamfered edge 76. An inflatable retainer 410 is attached to the inner surface 370 and, when inflated, rests against the sleeve 120. The retainer 410 functions as a means of locking the sleeve 120 to the chamber 360. A plurality of gear teeth 420 extend circumferentially around the outer surface 380 of the chamber for engaging a pinion 470.

The chamber 360 rests atop a housing 430, and a plurality of ball bearings 440 are interposed between the housing 430 and the chamber 360 for allowing the chamber 360 to be rotated as will be described hereinbelow. A bracket 450, which extends outwardly from the housing 430, supports a motor 460. The pinion 470 is positioned atop and attached, via an axle 480, to the motor 460. The motor 460 functions to rotate the axle 480 and, consequently, the pinion 470. The pinion 470 and the gear teeth 420 matingly interlock, and, when the motor 460 is operated, the pinion 470 rotates which, in turn, rotates the chamber 360. The retainer 410 rigidly attaches the chamber 360 to the sleeve 120 so that the rotation of the chamber 360 rotates the sleeve 120. The bearings 440 allow the chamber 360 to slidably rotate over the housing 430.

It is thought that the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described merely a preferred or exemplary embodiment thereof.

I claim:

1. A system for shot peening a first tube external to and concentric with a second tube, the system comprising:

a) cutting means for cutting a slot through the second tube;

b) a shot peening device cooperating with said cutting means for shot peening the first tube;

c) positioning means attached to said shot peening device for positioning said shot peening device inside the second tube adjacent the slot in the second tube; and d) propelling means attached to and cooperating with said shot peening device for propelling shot peening balls through the slot in the second tube for shot peening the first tube.

2. The system as in claim 1, further comprising rotating means cooperating with said shot peening device for circumferentially rotating the second tube in increments for shot peening an entire circumferential portion of the first tube positioned outwardly and radially from the slot.

3. The system as in claim 2, wherein said shot peening device comprises a panoramic nozzle for dispensing the shot peening balls through the slot in the first tube.

4. The system as in claim 3, wherein said cutting means is adapted to cut a slot defining a longitudinal extending slot.

5. The system as in claim 5, wherein the slot is 22 millimeters wide and 270 millimeters long for passing the shot peening balls therethrough.

6. A method for shot peening a first tube external to and concentric with a second tube, comprising the steps of:

a) forming a slot through the second tube;

b) positioning a shot peening device adjacent the slot in the second tube for propelling shot peening balls through the slot in the second tube; and c) propelling the shot peening balls through the slot in the second tube for shot peening the first tube.

7. The method of claim 6, further comprising the step of rotating the second tube in increments for shot peening an entire circumferential portion of the first tube positioned outwardly and radially from the slot.

8. The method of claim 7, wherein the step of propelling the shot peening balls comprises the step of propelling the shot peening balls through a panoramic nozzle for shot peening the second tube.

9. The method of claim 8, wherein the step of forming a slot through the second tube comprises the step of cutting a longitudinal slot for passing the shot peening balls therethrough.

10. The method of claim 9, wherein the step of cutting the longitudinal slot comprises the step of cutting a slot 22 millimeters wide and 270 millimeters long for passing the shot peening balls therethrough.

11. A method for shot peening a penetration tube of a nuclear reactor vessel, the penetration tube being external to and concentric with a thermal sleeve tube disposed inside the penetration tube, the method comprising the steps of:

a) forming a longitudinal slot through the thermal sleeve tube;

b) positioning a shot peening device adjacent the slot in the thermal sleeve tube for propelling shot peening balls;

c) propelling the shot peening balls through the slot in the thermal sleeve tube for shot peening the penetration tube; and d) rotating the thermal sleeve tube in increments for shot peening an entire circumferential portion of the penetration tube positioned outwardly and radially from the slot.

12. The method of claim 11, wherein the step of propelling the shot peening balls comprises the step of propelling the shot peening balls through a panoramic nozzle for shot peening the penetration tube.

* * * * *